United States Patent [19]

Kumagai et al.

[11] Patent Number: 4,995,350

[45] Date of Patent: Feb. 26, 1991

[54] 2-CYCLE UNI-FLOW SPARK-IGNITION ENGINE

[75] Inventors: Seiichiro Kumagai, Tokyo; Michikata Kono, Hachioji; Masakazu Okai, Kanagawa; Hisashi Inaga, Tokyo, all of Japan

[73] Assignee: Kioritz Corporation, Tokyo, Japan

[21] Appl. No.: 406,386

[22] Filed: Sep. 12, 1989

[30] Foreign Application Priority Data

Oct. 17, 1988 [JP] Japan ..... 63-261125

[51] Int. Cl.[5] ..... F02B 75/02

[52] U.S. Cl. ..... 123/65 VC; 123/90.14

[58] Field of Search ..... 123/65 VC, 73 PP, 65 R, 123/299, 65 A, 306, 308, 73 R, 73 C, 90.24, 90.14

[56] References Cited

U.S. PATENT DOCUMENTS

| | | | |
|---|---|---|---|
| 1,361,109 | 12/1920 | Spohrer | 123/90.14 |
| 1,438,915 | 12/1922 | Howe | 123/90.14 |
| 1,540,286 | 6/1925 | Roberts . | |
| 2,262,089 | 11/1941 | Brakmeier | 123/90.14 |
| 2,816,532 | 12/1957 | Ratliff | 123/90.24 |
| 3,289,658 | 12/1966 | Surovek | 123/90.24 |
| 4,592,313 | 6/1986 | Speckhart | 123/90.24 |
| 4,682,570 | 7/1987 | Velencei et al. | 123/73 PP |

FOREIGN PATENT DOCUMENTS

| | | | |
|---|---|---|---|
| 96732 | 12/1923 | Austria | 123/65 VC |
| 63571 | 6/1945 | Denmark | 123/90.14 |
| 129763 | 12/1900 | Fed. Rep. of Germany | 123/90.14 |
| 0096125 | 6/1983 | Japan | 123/65 VC |
| 87/07325 | 12/1987 | PCT Int'l Appl. | 123/65 VC |
| 19915 | 3/1913 | United Kingdom | 123/90.14 |
| 120251 | 10/1918 | United Kingdom . | |
| 198422 | 6/1923 | United Kingdom . | |
| 379561 | 9/1932 | United Kingdom | 123/65 BA |
| 507690 | 6/1939 | United Kingdom | 123/65 BA |
| 62-613 | 1/1987 | Japan . | |

*Primary Examiner*—David A. Okonsky

*Attorney, Agent, or Firm*—Browdy and Neimark

[57] ABSTRACT

A 2-cycle uni-flow spark-ignition engine has an annular scavenging chamber which is communicated with a crank chamber and which is connected to scavenging ports which are opened in an end period of downward stroking of a piston. A fluid introduced into the crank chamber is pre-compressed by the downward stroking of the engine and is discharged into a cylinder chamber through the annular scavenging chamber and the scavenging ports to form a uni-flow of scavenging fluid with a swirl above the piston. The engine has an exhaust valve provided on a cylinder head and normally opened by being driven with a predetermined force exerted by driving coiled spring towards the inside of the cylinder chamber. The exhaust valve is closed in the beginning period of compressing upward stroking of the piston so as to allow compression of the mixture introduced into the cylinder chamber and is automatically opened at the end period of expansion downward stroking of the piston after explosion and generation of power, so as to enable the combustion gas to be discharged as exhaust gas.

2 Claims, 4 Drawing Sheets

2-CYCLE UNI-FLOW SPARK-IGNITION ENGINE

BACKGROUND OF THE INVENTION

The present invention relates to a 2-cycle uni-flow internal combustion engine, in which a scavenging fluid which is air or a mixture of air and fuel and which has been pre-compressed in a crank chamber is introduced into a combustion chamber in a cylinder, and fuel is also supplied as required into the combustion chamber, the air-fuel mixture being then compressed by a piston and ignited by a spark so as to explode thereby producing output power, the combustion gas being then discharged as exhaust gas through one or more exhaust valves provided on the cylinder head.

Conventional 2-cycle spark-ignition internal combustion engines have their origin in a so-called three-port engine accomplished in 1891 by a British Engineer whose name is Day, J. In this type of engine, the air-fuel mixture supplied through a suction port provided in the wall of the cylinder is pre-compressed in the crank chamber and is supplied into the combustion chamber through a scavenging passage via a scavenging port provided in the portion of the cylinder wall on which the piston slides. The mixture is then compressed by the piston and is ignited by a spark so that the mixture explodes to produce power. After the combustion, the combustion gas is discharged as exhaust gas through an exhaust port provided in the portion of the wall of the cylinder on which the piston slides.

Several types of scavenging system have been proposed and used in this type of engine. For instance, a system so-called a loop scavenging system employs a scavenging port and an exhaust port which are arranged to diametrically oppose each other, while a projection provided on the head of the piston prevents the scavenging fluid from directly reaching the exhaust port. In a system known as a loop scavenging system, a plurality of scavenging ports are provided in symmetry on both sides of the exhaust port. Various combinations of these systems also are proposed. Although intense studies have been made with views to improve performance and fuel consumption in these systems, no further significant improvement seems to be attainable through such studies.

In general, ignitability of the mixture charged in the cylinders in the engines of the type described is inferior when compared with ordinary 4-cycle spark ignition engines due to the fact that the degree of dilution of the fresh mixture (mixture of air fuel) by the residual combustion gas is much greater than that in 4-cycle engines. This makes it difficult to operate 2-cycle engine with a lean mixture generally usable in 4-cycle engines. Namely, mis-fire tends to occur unless a specifically intense spark energy is supplied. Attempts for solving this problem in known 2-cycle engines have encountered with difficulty due to restriction from the scavenging system.

2-cycle engines also have various drawbacks such as large consumption of lubricating oil, as well as large amounts of emission of hydrocarbon and carbon monoxide attributable to conditions of scavenging and combustion peculiar in this type of engine. In addition, the exhaust gas has bad smell and contains smoke particles due to burning of lubricating oil introduced into the combustion chamber.

It is true that known 2-cycle engines have various advantages over 4-cycle engines of an equal engine displacement such as somewhat greater output power, simple construction and small size and weight, as well as lower production cost. Unfortunately, however, 2-cycle engines suffer from problems such as large rates of consumption of fuel and lubricating oil, possibility of environmental pollution due to nature of the exhaust gas, lack of stability and smoothness of operation, large vibration and noise, and so forth.

For these reasons, 2-cycle spark-ignition engines find only limited use in which advantages of this type of engine are fully enjoyed, e.g., small-sized portable agricultural machines, industrial machines, small motor bicycles, motor boats, and so forth. Thus, 2-cycle spark-ignition engines are excluded from uses where greater power is required as in the cases of automobiles, as well as uses where a demand exists for reduction in the noise level as in the cases of machines used in streets.

2-cycle uni-flow spark-ignition engines with overhead exhaust valve has been proposed in order to overcome the above-described problems. It has also been proposed to simplify this type of engine by eliminating valve actuating mechanisms.

SUMMARY OF THE INVENTION

Accordingly, an object of the present invention is to provide a 2-cycle uni-flow spark-ignition engine which has a simple construction and which can overcome and eliminate problems and drawbacks of the prior art without impairing the advantages inherently possessed by this type of engine.

To this end, according to the present invention, there is provided a 2-cycle uni-flow spark-ignition engine comprising: at least one cylinder defining therein a cylinder chamber; a piston reciprocatively received in the cylinder; a crank case defining therein a crank chamber; a scavenging system including an annular scavenging chamber provided on the cylinder along the inner periphery of the cylinder over the entire circumference of the cylinder, a plurality of scavenging ports provided in the wall of the cylinder so as to be opened to the cylinder chamber at the end period of the downward stroking of the piston and communicating with the annular scavenging chamber, and scavenging passages means for communicating the annular scavenging chamber with the crank chamber, so that the fluid introduced into the crank chamber is pressurized by the downward stroking of the piston so as to accumulate a pressure in the annular scavenging chamber through the scavenging passages means and is supplied through the scavenging ports into the cylinder chamber so as to form a scavenging uni-flow with a swirl in the cylinder chamber; a spark plug provided on the cylinder so as to confront the cylinder chamber; and an exhaust valve provided in the cylinder head and normally opened by being urged with a predetermined force exerted by urging means towards the inside of the cylinder chamber; whereby the exhaust valve is closed in the beginning period of compressing upward stroking of the piston so as to allow compression of the mixture introduced into the cylinder chamber and is automatically opened at the end period of expansion downward stroking of the piston after explosion and generation of power so as to enable the combustion gas to be discharged as exhaust gas.

In operation, the fluid introduced into the crank chamber is pressurized by a downward stroking of the piston and forced into the annular scavenging chamber so as to accumulate a pressure therein. When the scavenging ports are opened in the end period of the downward stroking of the piston, the fluid is discharged into the cylinder chamber as a scavenging fluid so as to form a swirl in the cylinder chamber. The fluid is then compressed by a subsequent upward stroking of the piston and ignited by a spark generated at the spark plug so as to explode and generate power. At the beginning period of the compression, the exhaust valve which is driven towards the cylinder chamber with a small force so as to be normally opened is closed to allow effective compression of the fluid. The exhaust valve is automatically opened when the pressure in the cylinder chamber has become low at the end period of the downward stroking of the piston in the course of expansion of the combustion gas, so as to allow the combustion gas to be discharged as exhaust gas. The exhaust valve which is normally opened can serve also as a decompression valve for facilitating start-up of the engine.

The 2-cycle uni-flow spark-ignition engine of the present invention offers various advantages such as increase in the output power, reduction of the fuel consumption, cleaning of the exhaust gases, and easiness of starting. In addition, this engine is simple in construction and small in weight, and exhibits a high reliability. Thus, the present invention proposes a novel type of engine which is expected to have wide application to various types of equipment and machines such as various industrial machines, transportation machines and so forth.

DESCRIPTION OF THE PREFERRED EMBODIMENT

Figure 1:
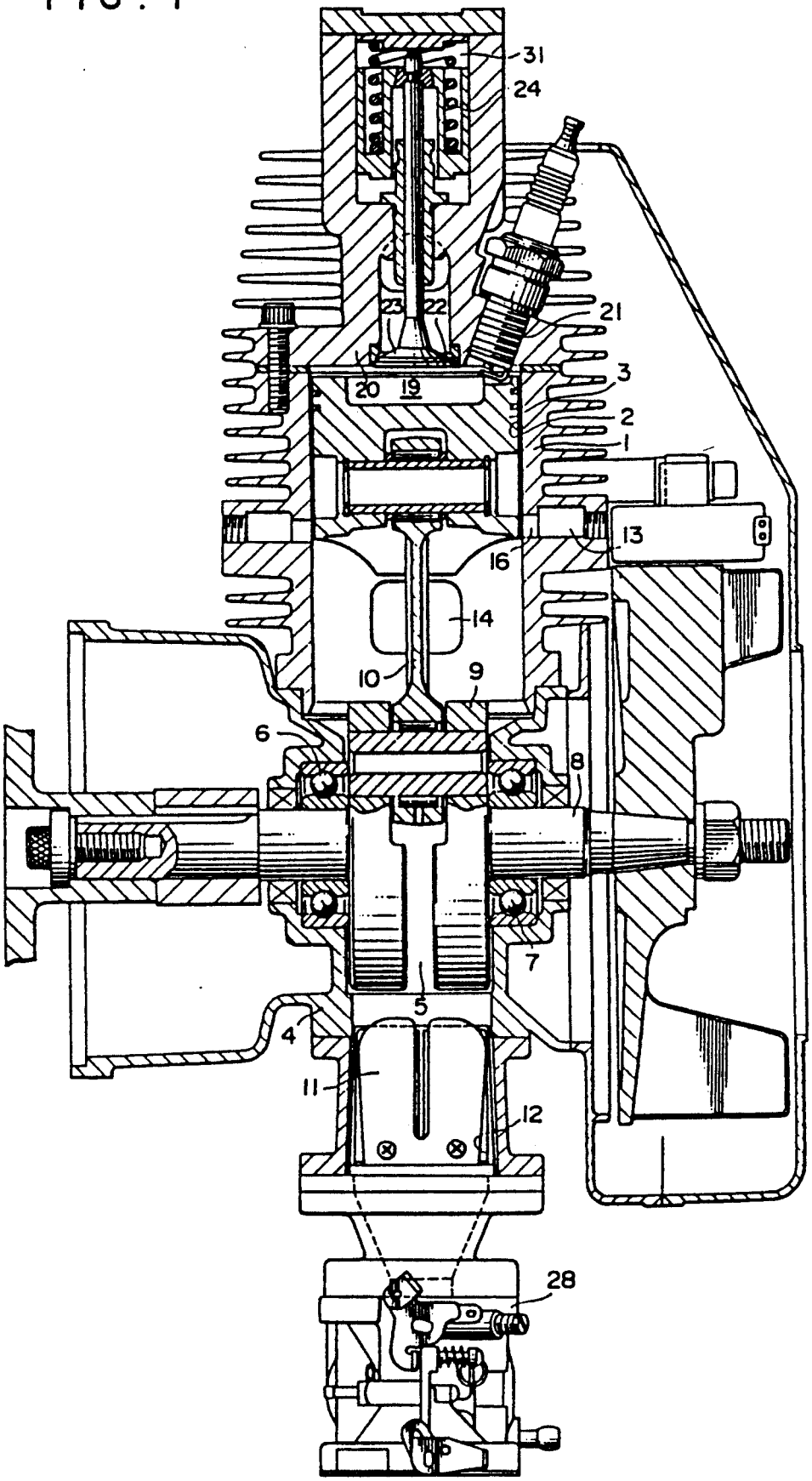
FIG. 1 is a longitudinal sectional view of an embodiment of a 2-cycle uni-flow spark-ignition engine in accordance with the present invention.

An embodiment of the present invention will be described with reference to the accompanying drawings.

Referring to FIGS. 1 to 4, a 2-cycle uni-flow spark-ignition engine of the present invention has a cylinder 1, a piston 3 reciprocatively received in the cylinder chamber 2 defined by the cylinder 1, and a crank case 4 connected to the lower end of the cylinder 1. The crank case 4 defines a closed crank chamber 5. The lower end portion of the cylinder chamber 2 and the upper end portion of the crank case 4 communicate with each other. The crank case 4 carries bearings 6 and 7 which rotatively support a crankshaft 8 having a crank 9 which is linked to the piston 3 through a connecting rod 10. The crank chamber 5 has an internal volume determined to just accommodate the rotation of the crank 9 and the reciprocative motion of the connecting rod 10. The arrangement is such that a fluid in the crank chamber 5 is pressurized by the movement of the piston 3 towards the bottom dead center. A suction port 12 provided in the wall of the crank chamber 5 is communicated with a carburetor 28 through a reed valve 11 so that an air-fuel mixture formed in the carburetor 28 can be sucked into the crank chamber 5 and the thus introduced mixture in the crank chamber 5 is pre-compressed so as to be used as the scavenging fluid as in the case of known engines explained before. The reed valve 11 may be substituted by a rotary valve (not shown) which is driven in synchronization with the rotation of the crankshaft 8. Although not shown, the arrangement may be such that the suction port for introducing the mixture into the crank chamber 5 is provided in a lower portion of the wall of the cylinder 1 so as to be opened and closed by the piston 3 which reciprocated in the cylinder 1 thereby controlling the supply of the air and other fluid into the crank chamber 5.

Figure 2:
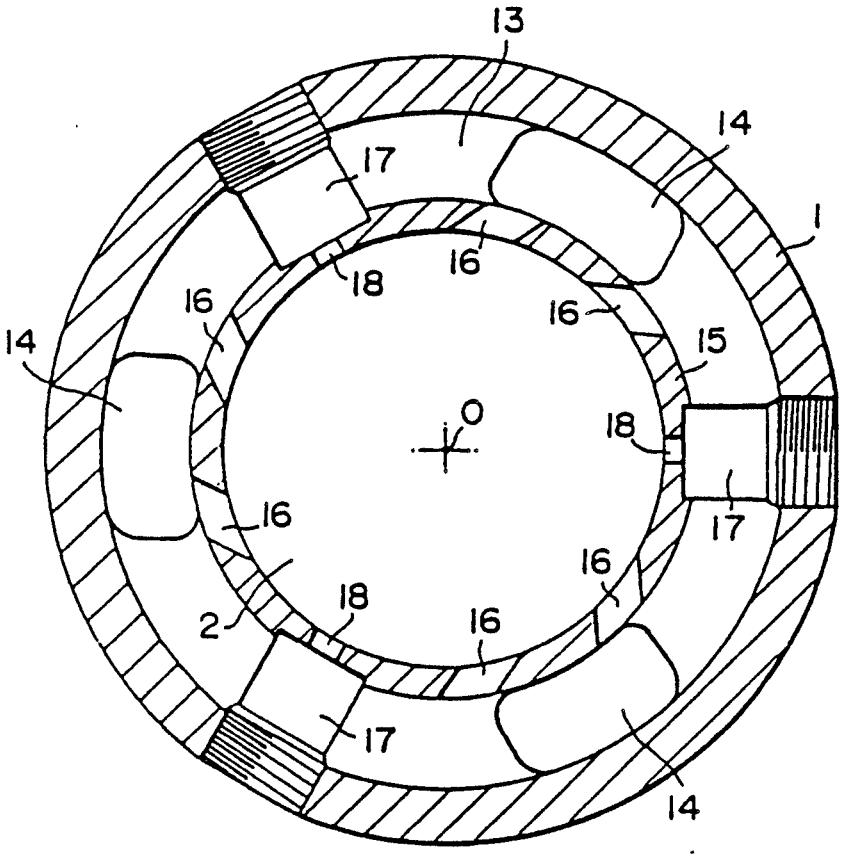
FIG. 2 is a cross-sectional view of a cylinder of the engine shown in FIG. 1.
Figure 3:
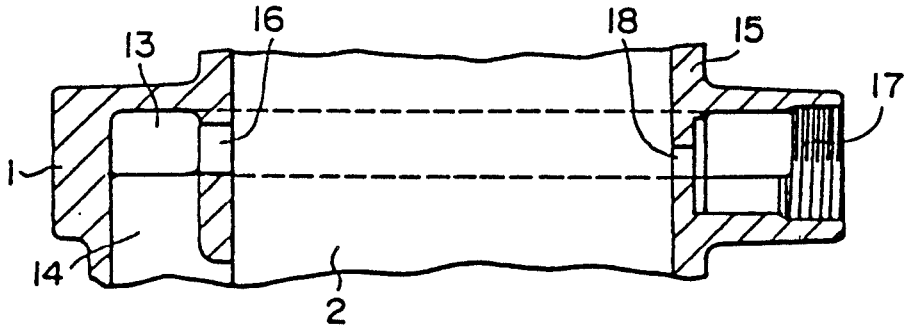
FIG. 3 is a longitudinal sectional view of the cylinder shown in FIG. 2.

The cylinder 1 is provided therein with an annular scavenging chamber 13 extending over the entire circumferential length thereof. The annular scavenging chamber 13 communicates at its lower portion with the crank chamber 5 through a plurality of scavenging passages 14 (three scavenging passages 14 are provided in this embodiment, as shown in FIG. 2) which are arranged below the scavenging chamber 13 substantially at a constant circumferential pitch or interval. The arrangement is such that the mixture pressurized in the crank chamber 5 is introduced into the annular scavenging chamber 13 so as to accumulate pressure in this chamber. The arrangement may be such that the scavenging fluid is introduced into the scavenging passages 14 through scavenging windows 29 (see FIG. 4) formed in the wall of the piston. The annular scavenging chamber 13 communicates with the interior of the cylinder chamber 2 through a plurality of scavenging ports 16 (nine scavenging ports 16 are provided in this case) formed in an inner wall portion 15 (see FIG. 2) of the cylinder 1. The scavenging ports 16 have their axes contained in a plane perpendicular to the axis O of the cylinder 1, as will be seen from FIG. 3, although they may be arranged at a slight inclination along an imaginary cone. As will be seen from FIG. 2, the scavenging ports 16 are so oriented that their axes are inclined at about 45° to the radial lines which pass the axis O of the cylinder 1. (see FIG. 2). This arrangement causes the fractions of the scavenging fluids introduced into the cylinder chamber 2 from the annular scavenging chamber 13 through the scavenging ports 16 to form a swirl along the inner peripheral surface of the cylinder 1. The arrangement, however, may be such that different scavenging ports have different inclination angles so as to realize a desire form of the swirl in the cylinder chamber 2.

The cylinder 1 is provided with a plurality of fuel injection nozzles 17 (three nozzles are used in this embodiment) which are arranged substantially at an equal circumferential spacing. The fuel injection nozzles 18 are provided with nozzle tips 18 which are directed from the wall 15 of the cylinder 1 towards the cylinder chamber 2 such that they inject the fuel towards an aimed point adjacent to the axis) of the cylinder chamber 2. In consequence, the portions of the fuel injected from the tips 18 of the respective fuel injection nozzles 17 collide at the aimed point near the axis O of the cylinder chamber 2 so as to be atomized, and the atomized fuel is mixed in the swirl of the scavenging air introduced into the cylinder chamber 2 through the scavenging ports 16. When the fuel injection nozzles 17 are of the type which atomizes the fuel by compressed air (air injection type), the arrangement may be such that the fuel injection nozzles 17 are communicated with the crank chamber 5 so as to be supplied with a portion of the air of high pressure compressed in the crank chamber 5. It is also possible to provide an air pump driven by the engine so as to supply compressed air to the fuel injection nozzles 17. The fuel injection nozzles 17, however, may of the type (solid injection type) which atomizes the fuel by the pressure of the fuel itself, without requiring any atomizing air.

The piston 3 may be materially the same as that used in known 2-cycle spark-ignition engine. In this embodiment, however, a recess 19 is provided in the piston crown so as to form a space for allowing a thick mixture to be burnt. When the scavenging windows 29 communicatable with the scavenging passages 14 are provided in the wall of the piston 3, the scavenging fluid flowing through such windows effectively cool the piston.

A spark plug 21 is provided on a cylinder head 20, i.e., at the top portion of the cylinder 1. The spark plug 21 is electrically connected to an electrical sparking circuit (not shown) such that it generates sparks when the piston has approached the top dead center of its stroke, thereby to ignite the air fuel mixture compressed by the piston 3 in the cylinder chamber 2.

Figure 4:
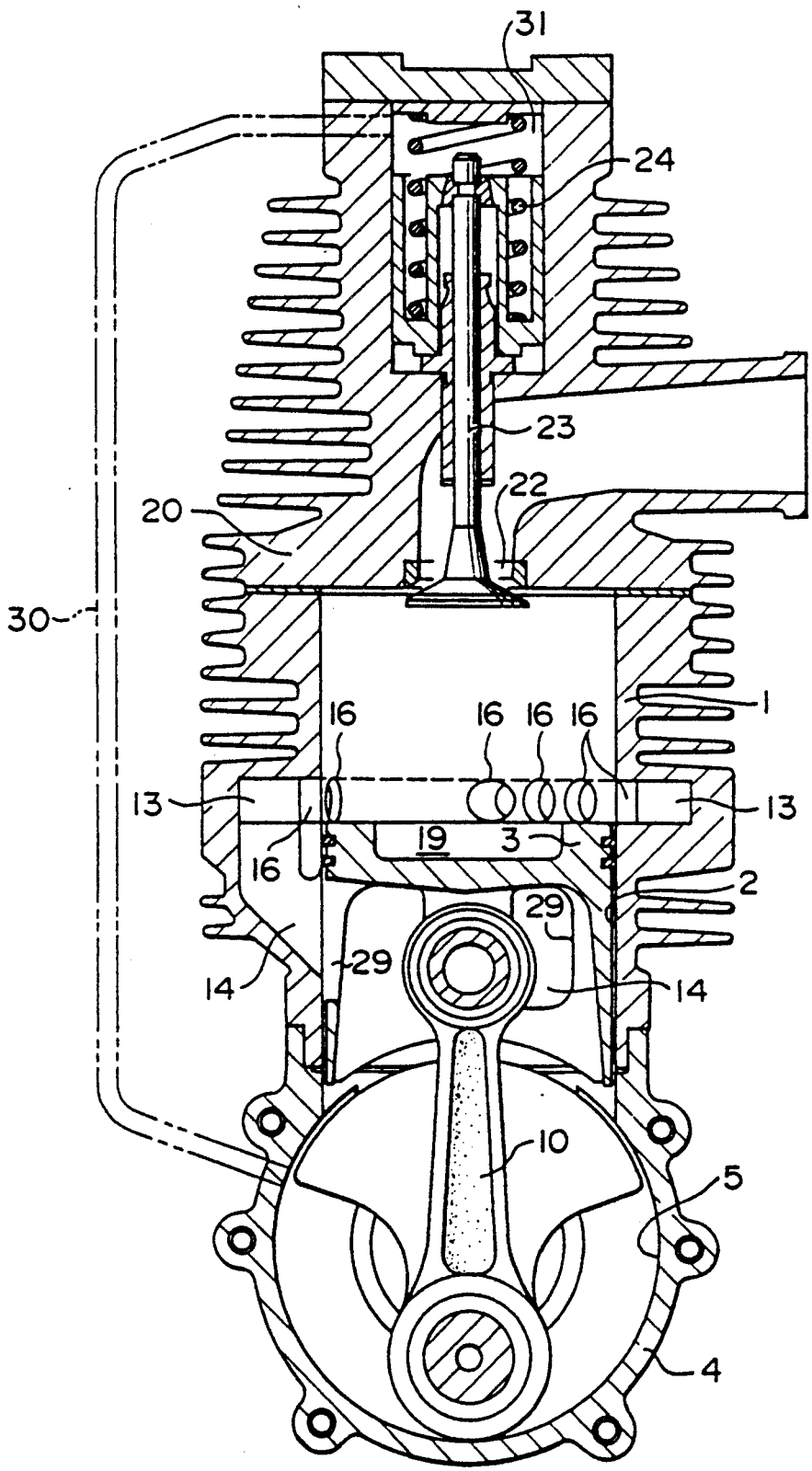
FIG. 4 is a longitudinal sectional view of the first embodiment taken at a plane which is perpendicular to the sectional plane of FIG. 1.

The cylinder head 20 of the cylinder 1 is provided with an exhaust port 22 which is concentric with the cylinder 1. The exhaust port 22 is adapted to be opened and closed by an exhaust valve 23. Unlike poppet-type overhead exhaust valve used in ordinary 4-cycle spark-ignition engines, the exhaust valve 23 is an automatic constant-lift valve which is driven so as to be normally opened with a predetermined small force exerted by a driving device such as a coiled spring 24 capable of driving the valve 23 towards the cylinder chamber 2. The exhaust valve 23 is adapted to be closed by initial period of compression of the scavenging fluid during upward stroking of the piston 3 so that the scavenging fluid can be fully compressed thereafter. The exhaust valve 23 is also closed during downward stroking of the piston 3 in the course of expansion of the combustion gas after explosion. The driving force of the coiled spring 24 is determined such that the exhaust valve 23 is allowed to open at an end period of the downward stroking of the piston 3 in which the pressure in the cylinder chamber 2 has been sufficiently lowered, so that the exhaust gas is discharged through the opened exhaust port 22. As shown in FIG. 4, a pressure conduit pipe 30 may be provided between the crank chamber 5 and a exhaust valve spring chamber 31 accommodating the coiled spring 24 so as to assist the operation of the exhaust valve 23 by the positive or negative pressure in the crank chamber 5. It is also to be noted that the exhaust valve 23, which is provided on the top of the cylinder, may be provided on the side wall of the cylinder so as to realize a so-called side-valve type system.

The illustrated embodiment also may be modified such that a secondary air supplying device is provided on the cylinder 1 so as to supply secondary air into the cylinder chamber 2 as required.

The supply of the lubricating oil maybe conducted in the same manner as those in ordinary 2-cycle spark-ignition engine. For instance, the lubricating oil may be supplied by a mixed oil lubrication system in which the lubricating oil is beforehand mixed with the fuel so as to be fed to the engine together with the fuel. It is also possible to use a separate oil lubrication system in which the lubricating oil is supplied by a pump to mechanical sliding portions or to the suction port of the engine so as to be mixed with the air or air-fuel mixture. From the view point of cleaning of the exhaust emissions, the separate oil lubrication system is preferably used.

Figure 5:
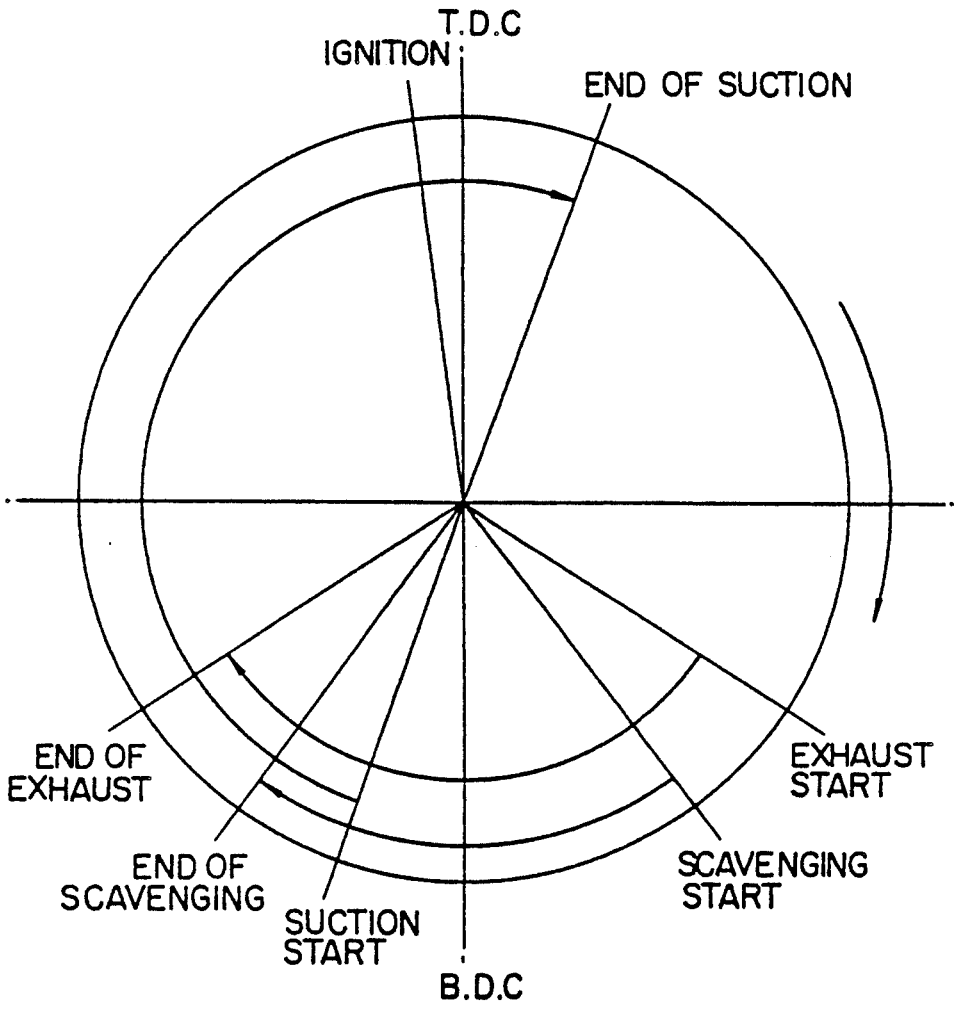
FIG. 5 is a diagram illustrating, in terms of crank angle, the operation of the engine to which the present invention is applied.

FIG. 5 is a diagram illustrative of the operation of the described embodiment of the 2-cycle uni-flow spark-ignition engine of the invention having a single cylinder, in relation to the angular position of the crank angle.

Although a single-cylinder engine has been described, the engine of the invention can be designed as a multi-cylinder engine as conventionally realized with 2-cycle spark-ignition engines. It is also to be understood that various types of cooling system, e.g., air- or water-cooled type cooling system, can be used for cooling the engine of the invention. Thus, the 2-cycle uniflow spark-ignition engine of the invention has a potential to widen the application of this type of engine to displacement region which is presently occupied by 4-cycle spark-ignition engines.

What is claimed is:

1. A 2-cycle uni-flow spark-ignition engine comprising:

at least one cylinder defining therein a cylinder chamber;

a piston reciprocatively received in said cylinder;

a crank case defining therein a crank chamber;

a scavenging system including an annular scavenging chamber provided on said cylinder along the inner periphery of said cylinder over the entire circumference of said cylinder, a plurality of scavenging ports provided in the wall of said cylinder so as to be opened to said cylinder chamber at the end period of the downward stroking of said piston and communicating with said annular scavenging chamber, and scavenging passages means for communicating said annular scavenging chamber with said crank chamber, so that the fluid introduced into said crank chamber is pressurized by the downward stroking of said piston so as to accumulate a pressure in said annular scavenging chamber through said scavenging passages means and is supplied through said scavenging ports into said cylinder chamber so as to form a scavenging uniflow with a swirl in said cylinder chamber;

a spark plug provided on said cylinder so as to confront said cylinder chamber; and an exhaust valve provided on the top of the cylinder and normally opened by being driven with a predetermined force exerted by driving coiled spring means (24) towards the inside of said cylinder chamber;

whereby said exhaust valve is closed in the beginning period of compressing upward stroking of said piston so as to allow compression of the mixture introduced into said cylinder chamber and is automatically opened at an end period of expansion downward stroking of said piston after explosion and generation of power so as to enable the combustion gas to be discharged as exhaust gas.

2. A 2-cycle uni-flow spark-ignition engine according to Claim 1, further comprising a pressure communicating conduit pipe which provides a communication between a chamber accommodating said driving coiled spring means and said crank chamber so as to enable the positive or negative pressure generated in said crank chamber to assist the opening and closing action of said exhaust valve.

* * * * *